United States Patent [19]

Majewski et al.

[11] Patent Number: 4,642,258

[45] Date of Patent: Feb. 10, 1987

[54] TREATMENT OF FABRICS IN MACHINE DRYERS USING TREATING MEANS CONTAINING FABRIC TREATING COMPOSITION HAVING RESISTANCE TO CHANGE IN VISCOSITY AND RELEASE RATE WITH TEMPERATURE CHANGE

[75] Inventors: Donna M. Majewski, Lino Lakes; Stephen A. Morganson, S. St. Paul, both of Minn.

[73] Assignee: Economics Laboratory, Inc., St. Paul, Minn.

[21] Appl. No.: 510,943

[22] Filed: Jul. 5, 1983

[51] Int. Cl.[4] ..... B05D 1/28; B65D 85/70; F26B 3/00

[52] U.S. Cl. ..... 428/68; 34/9; 141/10; 206/0.5; 206/524.1; 252/8.8; 252/8.9; 427/11; 427/242; 428/76

[58] Field of Search ..... 427/11, 242; 252/8.9, 252/8.8; 34/9; 206/0.5, 524.1; 428/68, 76; 141/10

[56] References Cited

U.S. PATENT DOCUMENTS

| | | | |
|---|---|---|---|
| 3,650,816 | 3/1972 | Rudy et al. | 427/242 |
| 3,686,025 | 8/1972 | Morton et al. | 427/242 |
| 3,861,870 | 1/1975 | Edwards et al. | 252/8.8 |
| 3,967,008 | 6/1976 | Miyuno et al. | 427/242 |
| 4,118,525 | 10/1978 | Jones | 427/242 |
| 4,149,977 | 4/1979 | Morganson et al. | 252/8.8 |
| 4,223,029 | 9/1980 | Mahler et al. | 427/242 |
| 4,259,373 | 3/1981 | Demessemaekers | 427/242 |
| 4,297,406 | 10/1981 | Metcalfe et al. | 427/242 |
| 4,389,448 | 6/1983 | Green | 427/242 |

*Primary Examiner*—James C. Cannon

*Attorney, Agent, or Firm*—Merchant, Gould, Smith, Edell, Welter & Schmidt

[57] ABSTRACT

A reusable permeable dispenser for dispensing solid or semi-solid fabric conditioning agent which can be attached to a machine dryer drum or tumbles loosely in the dryer, comprising a flexible permeable container comprising a composition of a quarternary ammonium anti-static agent, a polyalkylene oxide compound, and silicone dioxide which has a substantially constant release rate regardless of dryer operator temperature.

23 Claims, No Drawings

TREATMENT OF FABRICS IN MACHINE DRYERS USING TREATING MEANS CONTAINING FABRIC TREATING COMPOSITION HAVING RESISTANCE TO CHANGE IN VISCOSITY AND RELEASE RATE WITH TEMPERATURE CHANGE

FIELD OF THE INVENTION

The invention relates to a reusable dispenser of a fabric treating composition which can be used in machine dryers in order to render clothes soft and anti-static. More particularly, the invention relates to the use of a fabric treating composition that is stable in viscosity and release rate over a very broad temperature range.

BACKGROUND OF THE INVENTION

During both washing and drying of clothes it is common to treat various types of fabrics such as wool, cotton, silk, nylon, polyester, permanent-press, and the like with treating agents such as anti-static, anti-bacterial or deodorant agents which condition fabric, soften fabric, and reduce fabric tangling, knotting or wrinkling.

The fabric treating agents have been added to wash or rinse cycles of clothes washers and have successfully treated fabrics. However, adding the fabric treating agents to rinse water can result in the release of substantial amounts of polluting agents. Further, the addition of a fabric treating agent to a wash cycle or to a rinse cycle can be easily forgotten and the fabric treating agent can be easily mismeasured.

In recent years increasing attention to the addition of fabric treating compositions to machine dryers has occurred. Fabric treating compositions have been sprayed or coated onto the machine drum as is shown in U.S. Pat. Nos. 2,812,593; 2,846,276; 3,002,288; and 3,650,816. Fabric treating compositions have been coated on flexible substrates that can act as a single use fabric treating releasing means acting by mechanical contact and are shown in U.S. Pat. Nos. 3,442,692; 3,686,025; and 4,149,977. These methods of adding fabric treating agents suffer from the drawback that they commonly must be added to the dryer with each load of damp clothes.

In response to a need for providing fabric treating compositions to dryer loads using means that can be placed in the drum to provide a controlled release of fabric treating material for a number of drying cycles (10 or more), a flexible fabric pouch or envelope having a fabric treating composition which is slowly released during each drying cycle was proposed, see for example U.S. Pat. Nos. 3,870,145; 3,967,008; 4,004,685; and 4,098,937. The compositions in these fabric treating means commonly include two fabric treating agents having a high temperature and a low temperature softening point which can provide a somewhat controlled release of fabric treating agent over a spectrum of temperatures in the drying cycle. These systems can suffer from the drawback that the treating compositions can be released at differing rates at differing temperatures through the drying cycle, and at high temperature the treating means can release sufficient treating agent that clothes can become marked, spotted or soiled by the fabric treating agent.

The control over release of treating agent over a range of temperatures was obtained to a certain extent by including in the softening compositions disclosed in U.S. Pat. No. 4,149,977 a softening or anti-static amount of a quaternary tetrahydrocarbyl-ammonium compound, a softening point depressant for the quaternary ammonium compound comprising an alkanol amide, and a viscosity modifier comprising silica. The quaternary ammonium compound and the alkanolamide compositions interact and reduce the softening point of the fabric treating composition, and the silica controls viscosity. However, the release rates can vary substantially at dryer operating temperatures between about 40° C. and 90° C. However, even in this controlled system substantial amounts of treating agent can be released at high temperature, staining, marking or spotting clothes in the dryer load.

Clearly a substantial need exists to provide a composition that changes little in viscosity and release rate in response to change in temperature and at a rate substantially less than prior fabric treating agents.

SUMMARY OF THE INVENTION

We have found that the control of viscosity and release rate of the fabric treating agents can be substantially obtained by forming a composition comprising a quaternary ammonium salt softening agent, a polyalkylene oxide compound, and silica. Earlier solid treating agents generally comprised higher melting components in combination with a small amount of silica thickener. Higher melting components were used since it was found that if low melting compounds were used, excess treating agent would be released at high temperatures, resulting in substantial marking and staining of clothes. It was found that higher levels of silica, while being effective in controlling viscosity change, also resulted in a "hard" fabric softener that could release insufficient amounts of fabric softener over 40 or more cycles. The low melting components of this invention have been chosen for the interaction that the components have with substantially higher levels of silica that were ineffective in prior softening compositions would interact surprisingly with lower melting components providing a composition which has an essentially constant release rate of treating agent over the operating range of dryers.

DETAILED DESCRIPTION OF THE INVENTION

The fabric treating agents used in the products of the invention are softening agents or anti-static agents which make fabrics feel soft to the touch and reduce the incidence of static electricity. A preferred fabric softening agent comprises quaternary ammonium compounds having the general formula:

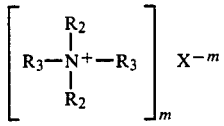

wherein $R_2$ and $R_3$ are independently hydrocarbyl groups, having 1 to 24 carbon atoms, which can be saturated or unsaturated linear or branched, or which may contain substituent groups such as hydroxyl, halo, nitro, etc. Preferably, $R_2$ is independently $C_{1-4}$ alkyl and $R_3$ are independently $C_5$–$C_{24}$ alkyl. X is an anion and m, the valency of X, is an integer that ranges from 1 to 4. Suitable $X^{-m}$ anions include $CL^-$, $BR^-$, $I^-$, $HSO_4^-$, $SO_4^{-2}$, $H_2PO_4^-$, $HPO_4^{-2}$, $CH_3COO_2^-$, $HCO_2^-$, etc. Preferred anions are chloride, methyl sulfate and acetate. Typical commercial products of this type are dimethyl-di $C_{12-24}$ alkyl ammonium chloride, such as dimethyl di $C_{12-14}$ alkyl ammonium chloride, dimethyl di $C_{14-16}$ alkyl ammonium chloride, dimethyl-di $C_{16-18}$ alkyl ammonium chloride, di(stearoyloxyethyl), dimethyl ammonium chloride, and 3-behenoyloxy-2-hydroxy propyl trimethyl ammonium chloride.

The novel composition of the invention an also contain a major portion of an alkoxylated compound of the formula:

$$[(\text{alkoxy}-O)_n]_m A \qquad \text{I}$$

or $$(CH_3-\underset{R_1}{CH}-O(CH_2\underset{R_1}{CH}-O)_n]_m A \qquad \text{II}$$

wherein in I n is an integer of 10 to 1,000, m is an integer from 1 to 4, (alkoxy) refers to any polyalkoxy substituent and A refers to a moiety wherein the A-moiety containing compound can be alkoxylated using typical alkoxylating agents which generally comprise cyclic ethers which can operate through a ring opening polymerization reaction to result in a polymerized substituent. In II R is hydrogen or $C_{1-4}$ alkyl, n is an integer of 10 to 1,000, and m is an integer from 1 to 4. Most common alkoxylating agents comprise oxirane type compounds such as ethylene oxide, propylene oxide, 1,2-butylene oxide, 1,3-butylene oxide, 2,3-butylene oxide, and others. Typical A-moiety containing compounds include amine compounds, aliphatic alcohols, alkyl phenols, carbohydrates, mono and dicarboxylic acids, mono and dicarboxylic acid amides, mono or dicarboxylic acid esters, and polyalkylene glycols. Preferred polyalkoxylated compounds are the polyalkoxylated or polypropoxylated mono and dicarboxylic acids having polyalkoxy substituents having from about 100 to about 750 alkoxy units. Still more preferred compounds include alkoxylated or propoxylated saturated and unsaturated fatty acids and alkoxylated and propoxylated substituted succinic acids. Most preferred compounds are the ethoxylated fatty acids wherein the fatty acid moiety has from about 12 to 24 carbon atoms such as ethoxylated lauric acid, ethoxylated palmitic acid, ethoxylated stearic acid, ethoxylated behenic acid, ethoxylated linoleic acid, and ethoxylated linolenic acid.

The preferred viscosity modifier that cooperates with the polyalkoxy compound in providing substantial control over viscosity change with temperature comprises silicon dioxide. The preferred form of silicon dioxide is fumed silica which comprises colloidal-like particulate masses of silicon made by hydrolysis of silicon tetrahalide. Average particle size of the colloid is well below 1 micron, and typically is below 0.1 micron. Colloidal silica is commercially available as CAB-O-SIL TM.

Additional additives can be used to improve the characteristics of the compound including additives which provide rigidity to the bar, which provide fragrance or ease of handling and packaging.

The above compositions are blended and introduced into a dispenser having a permeable surface which can be installed in the drum of the machine dryer. The fabric conditioning composition of this invention provides softening and viscosity characteristic-modifying compounds at dryer temperatures which range from about 30° C. to as high as 95° C. The compositions of this invention are placed within a permeable dispensing means which releases or dispenses the composition at a rate of about 0.1 to about 0.8 gram per machine drying cycle. (0.1–0.8 g/cycle). Substantially less than about 0.1 gram per cycle anti-static or fabric-treating effects are generally not obtained. At greater than about 1.0–1.2 grams per cycle, marking and staining of fabric can be observed. The optimum dispensing or release rate of the fabric conditioning composition comprises about 0.2–0.5 gram per cycle.

A preferred form of the release means comprises a closely woven fabric envelope which wholly surrounds the fabric treating composition. A particularly advantageous method of this invention involves installing the fabric envelope on the drum of the dryer, preferably on a leading edge of a dryer vane. In the instance that attachment of the fabric envelope to the drum or the dryer vane is impractical, the fabric envelope can be tumbled with the clothes load. However, it is certain that minimization of marking and staining can be reduced if contact of the clothes with the dispenser is reduced.

In somewhat greater detail, to form a fabric treating composition having a stable controlled viscosity throughout the range of temperatures found in machine dryers, the composition should comprise about 20 to 80 wt-% of the polyalkylene glycol compound, about 20 to about 80 wt-% of the tetrahydrocarbyl-substituted ammonium salt, about 5 to about 15% silicon dioxide and about 0 to 5 wt-% of a fragrance. The preferred composition consists essentially of a major proportion of the polyalkylene oxide composition, about 10–30 wt-% of a dialkyl di $C_{12-24}$ alkyl ammonium halide, about 8–10.5 wt-% silica, and about 0.5–4 wt-% fragrance. The most preferred composition comprises a major proportion of a polyethylene glycol monostearate having a melting point of less than about 100° C., having from 300 to 500 polyethylene oxy oxide residues, about 10–30 wt-% of a dimethyl di $C_{12-18}$ ammonium chloride, about 9 to about 10 wt-% of silicon dioxide, and about 2–3 wt-% fragrance.

While we do not wish to be limited to a theory of action of the invention, we believe that the silicon dioxide and the polyalkoxy and other groups present in the polyalkaline oxide compound interact through hydrogen bonding to increase the viscosity substantially, thus lowering the solidification range of the material. Thus the softening op;int of the material is substantially lowered, resulting in a constant release rate regardless of the operating temperature range of the machine dryer. In the preferred method of manufacturing the fabric treating article of this invention, an envelope can be fashioned from fabric rendered lipophobic and hydrophobic. The envelope is generally sealed along at least one edge, preferably along three edges, and is held in a convenient position for adding the fabric treating composition. The fabric treating composition is generally kept in a reservoir maintained above the temperature at which the composition begins to flow. Into the unsealed fabric envelope is placed about 1 to about 30 grams of the hot viscous liquid. The envelope can then be sealed using convenient conventional means.

The dispenser of the fabric treating composition consists of an outer envelope or shell, at least a portion of which must either expose the fabric treating composition to the treated clothes or be permeable to the fabric treating compositions of the invention. The fabric treating compositions of the invention are generally wholly or at least partially enclosed by the dispenser means. It is peferable to construct an envelope of cloth or fabric, either woven or nonwoven, for reasons of ease of construction and economical manufacture. Cotton/polyester, for example DACRON TM, is a particularly effective material for the dispenser means. The nature of the material of the dispenser can be varied to control rate of migration or penetration of the fabric treating composition through the material.

Dispensing means is often secured to the dryer machine drum using attaching means secured to the envelope. Common attaching means can be used. In the instance that the dispensing means is attached to the dryer drum and removed after a number of cycles, and is not to be replaced in the dryer, a layer of pressure-sensitive adhesive can be provided. Further details with respect to the dispensing means can be found in U.S. Pat. Nos. 4,004,685 and 4,149,977 which are expressly incorporated herein. The wicking or permeation of the permeable surface of the dispensing means can be controlled by treating the fabric with a hydrophobic and lipophobic organic polymer such as fluorinated polymer known as SCOTCH-GUARD TM.

The invention is further illustrated by the following specific Examples, which should not be used in unduly limiting the scope of the invention or the claims. In the Examples, which contain the best mode, all parts are in parts by weight or in weight-% unless otherwise specifically indicated.

EXAMPLE I

Into a 250 milliliter beaker was added 9.5 parts of silicon dioxide (CABOSIL TM M-5), 68 grams of a polyethyleneoxide substituted stearate having a molecular weight of 400 (LIPAL 400 MS TM), and 20 grams of a dimethyl di-$C_{15}$ alkyl ammonium chloride (ADOGEN 432 TM). The beaker and its contents were heated in an oven at a temperature of about 250° F. As the components began to melt, 2.5 grams of a fragrance was added to the melt and the melt was stirred by hand until uniform. The uniform mixture appeared to be an almost clear viscous material. The hot melt material was placed in a treated DACRON TM pouch formed by folding a 4"×5" piece of material and sealing the short dimensions. The resulting pouch had dimensions of 4"×2½" and into the pouch was placed 20 grams of the melt. The melt cooled and the pouch was sealed along the remaining dimensions. Two thus-formed pouches were attached along one edge to form a dual pouch having approximate dimensions of 2½"×7¾" together. Similar pouches were made and tested in the following procedure.

The pouches were tested in dryers over 19 cycles for release of treating material and the presence of fragrance on the pouch fabric dryer and the presence of softening.

TABLE 1

| Cycle No. | Treating Composition Weight at End of Dryer Cycle* | Weight Loss (gm) | Fragrance on Clothes | Fragrance on Dryer | Static | Softening |
|---|---|---|---|---|---|---|
| 1 | 47.21 | 1.13 | — | — | — | x |
| 2 | 45.95 | 1.26 | — | — | — | x |
| 3 | 44.91 | 1.04 | — | — | — | x |
| 4 | 43.64 | 1.27 | — | — | — | x |
| 5 | 42.61 | 1.03 | — | — | — | x |
| 6 | 41.38 | 1.23 | — | — | — | x |
| 7 | 40.51 | .87 | — | — | — | x |
| 8 | 39.67 | .84 | — | — | — | x |
| 9 | 38.85 | .82 | — | — | — | x |
| 10 | 38.50 | .35 | — | — | — | x |
| 11 | 37.87 | .63 | — | — | — | x |
| 12 | 36.57 | 1.30 | — | — | — | x |
| 13 | 35.87 | .70 | — | — | — | x |
| 14 | 35.25 | .62 | — | — | — | x |
| 15 | 34.76 | .49 | — | — | — | x |
| 10 | 34.40 | .36 | — | — | — | x |
| 17 | 34.00 | .40 | — | — | — | x |
| 18 | 33.66 | .34 | — | — | — | x |
| 19 | 33.28 | .38 | — | — | — | x |

*Initial treating composition weight 48.34.
x = present
— = absent

Table 1 shows that the product of Example I successfully softens and removes static from clothes. The absence of fragrance on clothes or dryer indicates that the release rate of the composition is sufficient to provide softening and anti-static properties, but does not release at a rate which would soil or mark clothes. Table 1 further shows that the release rate of the material varies from about 1.13 grams to about 0.38 grams. At least 0.02 grams of fabric treating agent must be released in order to provide any substantial amount of softening or anti-static properties.

EXAMPLE II

Into a 200 milliliter beaker was placed 69.0 parts of polyethylene oxide substituted stearate (LIPAL 400 MS TM) having a molecular weight of 400, 8.50 grams of silicon dioxide (CABOSIL M-5 TM), and 20 grams of dimethyl di-$C_{15}$ alkyl ammonium chloride. The beaker and its contents were placed in an oven at a temperature of about 250° F. and stirred by hand until melted. Into the melt was placed 2.5 grams of fragrance and the mixture was stirred until uniform. The hot melt was placed into a three-pocket pouch having 13.5, 15.0, and 13.5 grams respectively per pouch. The test softening means was placed in a dryer and was tested for release of the softening components. The following Table shows the preparation of Examples II–XIII, the individual components and a five-cycle average of the release of the fabric treating composition.

TABLE 2

| Ex. | Polyethylene Oxy-stearate | $SiO_2$ | Fragrance | di Me di $C_{15}$ alkyl Ammonium Chloride | 5-Cycle Average |
|---|---|---|---|---|---|
| II | 69.00 | 8.50 | 2.50 | 20.00 | .92 |
| III | 69.00 | 5.98 | 2.50 | 22.52 | 1.61 |
| IV | 63.00 | 10.00 | 2.50 | 24.50 | .56 |
| VI | 58.92 | 8.50 | 2.50 | 30.08 | .65 |
| VII | 75.00 | 7.00 | 2.50 | 15.50 | 1.12 |
| VIII | 69.00 | 8.50 | 2.50 | 20.00 | .87 |
| IX | 63.00 | 7.00 | 2.50 | 27.50 | 1.02 |
| X | 79.08 | 8.50 | 2.50 | 9.92 | .78 |
| XI | 75.00 | 10.00 | 2.50 | 12.50 | .61 |
| XII | 69.00 | 8.50 | 2.50 | 20.00 | .81 |
| XIII | 69.00 | 11.02 | 2.50 | 17.48 | .45 |

Table 2 shows that the fabric softening composition can be used having a silicon dioxide content from about 6 to about 11% and greater, and obtains substantial but controlled release of the fabric softening components.

The foregoing description, Examples, and data are illustrative of the invention described herein, and should not be used to unduly limit the scope of the invention or claims. Since many embodiments and variations can be made while remaining within the spirit and scope of the invention, the invention resides wholly in the claims hereinafter appended.

We claim:

1. A fabric treating article of commerce comprising:

(a) a dispenser body enclosing or substantially surrounding, (b) a fabric conditioning composition consisting essentially of:

(i) about 20 to 80 wt-% of an alkoxylated compound having the formula:

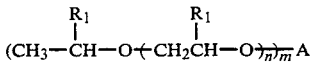

wherein $R_1$ is hydrogen or $C_{1-5}$ alkyl, A is an alkyl, a carboxyl, an aryl, a substituted aryl, or an alkylene glycol moiety having from about 1 to 30 carbon atoms, m is an integer of 1 to 4, and n is a number of about 100 to 1,000;

(ii) about 10 to 30 wt-% of a di $C_{1-4}$ alkyl-di $C_{5-24}$ alkyl ammonium compound;

(iii) about 8 to 12 wt-% silicon dioxide; and (iv) about 0 to 5 wt-% of fragrance.

2. The article of claim 1 wherein the dispenser body comprises a woven permeable fabric envelope.

3. The article of claim 2 wherein the fabric comprises dacron treated with a hydrophobic, lipophobic agent.

4. The article of claim 3 wherein the fabric envelope is made by obtaining fabric pieces of similar size and attaching the fabric pieces with construction means along the edges of the pieces.

5. The article of claim 1 wherein the di $C_{1-4}$ alkyl-di $C_{5-24}$ alkyl ammonium compound has the formula:

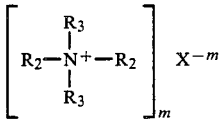

wherein $R_2$ is $C_{5-24}$, $R_3$ is $C_{1-4}$, m is an integer of 1 to 4, and X is an inorganic anion.

6. The article of claim 5 wherein $R_2$ is $C_{12}$–$C_{18}$ alkyl and $R_3$ is methyl.

7. The article of claim 5 wherein $X^{-m}$ is $CL^-$, $SO_4^{-2}$, or $HPO_4^{-2}$.

8. The article of claim 1 wherein the alkoxylated compound comprises an alkoxylated mono-carboxylic acid or an alkoxylated dicarboxylic acid.

9. The article of claim 8 wherein the alkoxylated mono-carboxylic acid is an alkoxylated fatty acid.

10. The article of claim 8 wherein the alkoxylated carboxylic acid comprises ethoxylated fatty acid, wherein the fatty acid moiety has from 12 to 24 carbon atoms.

11. The article of claim 1 wherein silicon dioxide is present at an amount of about 8 to 10.5 wt-%.

12. The article of claim 1 wherein silicon dioxide is present at an amount of about 9 to 10 wt-%.

13. A fabric softening composition of matter which consists essentially of:

(i) about 20 to 80 wt-% of an alkoxylated compound having the formula:

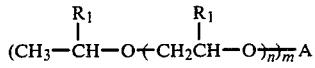

wherein $R_1$ is a hydrogen or $C_{1-5}$ alkyl, A is an alkyl, a carboxyl, an aryl, a substituted aryl, or an alkylene glycol moiety having from about 1 to 30 carbon atoms, m is an integer of 1 to 4, and n is a number of about 100 to 1,000;

(ii) about 10 to 30 wt-% of a di $C_{1-4}$ alkyl-di $C_{5-24}$ alkyl ammonium compound;

(iii) about 8 to 12 wt-% of silicon dioxide; and (iv) about 0 to 5 wt-% of fragrance.

14. The composition of claim 13 wherein the di $C_{1-4}$ alkyl-di $C_{5-24}$ alkyl ammonium compound has the formula:

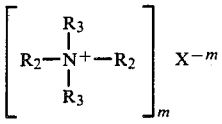

wherein $R_2$ is $C_{5-24}$, $R_3$ is $C_{1-4}$, m is an integer of 1 to 4, and X is an inorganic anion.

15. The composition of claim 14 wherein $R_2$ is $C_{12}$–$C_{18}$ alkyl and $R_3$ is methyl.

16. The composition of claim 14 wherein $X^{-m}$ is $CL^-$, $SO_4^{2-}$ or $HPO_4^{-2}$.

17. The composition of claim 13 wherein the alkoxylated compound comprises an alkoxylated mono-carboxylic acid or an alkoxylated dicarboxylic acid.

18. The composition of claim 17 wherein the alkoxylated mono-carboxylic acid is an alkoxylated fatty acid.

19. The composition of claim 17 wherein the alkoxylated carboxylic acid comprises ethoxylated fatty acid, wherein the fatty acid moiety has from 12 to 24 carbon atoms.

20. The composition of claim 13 wherein silicon dioxide is present at an amount of about 8 to 10.5 wt-%.

21. The composition of claim 13 wherein silicon dioxide is present at an amount of about 9 to 10 wt-%.

22. A method for forming a slow release fabric treating article of commerce which comprises:

(a) obtaining at least one piece of a woven or nonwoven fabric permeable to solid fabric treating compositions;

(b) attaching at least two edges of the fabric;

(c) introducing an effective amount of a fabric softening anti-static composition which consists essentially of:

(i) about 20 to 80 wt-% of an alkoxylated compound having the formula:

$$(CH_3-\overset{R_1}{\overset{|}{CH}}-O\underset{n}{(}CH_2\overset{R_1}{\overset{|}{CH}}-O\underset{m}{)})A$$

wherein $R_1$ is a hydrogen or $C_{1-5}$ alkyl, A is an alkyl, a carboxyl, an aryl, a substituted aryl, or an alkylene glycol moiety having from about 1 to 30 carbon atoms, m is an integer of 1 to 4, and n is a number of about 100 to 1,000;

(ii) about 10 to 30 wt-% of a di $C_{1-4}$ alkyl-di $C_{5-24}$ alkyl ammonium compound;

(iii) about 8 to 12 wt-% of silicon dioxide; and (iv) about 0 to 5 wt-% of fragrance;

and sealing the fabric, enclosing or substantially surrounding the fabric softening anti-static composition.

23. A method for treating fabric which comprises drying fabric in a mechanical dryer containing the article of claim 1.

* * * * *